US010814652B2

(12) United States Patent
Muraoka et al.

(10) Patent No.: US 10,814,652 B2
(45) Date of Patent: Oct. 27, 2020

(54) INKJET RECORDING APPARATUS

(71) Applicant: KYOCERA Document Solutions Inc., Osaka (JP)

(72) Inventors: Toshinori Muraoka, Osaka (JP); Naoki Yamane, Osaka (JP); Satoru Nakamura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/418,215

(22) Filed: May 21, 2019

(65) Prior Publication Data

US 2019/0358969 A1 Nov. 28, 2019

(30) Foreign Application Priority Data

May 22, 2018 (JP) ..... 2018-097811

(51) Int. Cl.
*B41J 29/38* (2006.01)
*B41J 11/00* (2006.01)
*B41J 25/00* (2006.01)

(52) U.S. Cl.
CPC ..... *B41J 11/007* (2013.01); *B41J 25/00* (2013.01); *B41J 29/38* (2013.01)

(58) Field of Classification Search
USPC ..... 347/8
See application file for complete search history.

(56) References Cited

U.S. PATENT DOCUMENTS 7,866,774 B2 1/2011 Ikeda et al.
8,459,763 B2 * 6/2013 Yamanobe ..... B41J 11/0015 347/8
2008/0284803 A1 * 11/2008 Ikeda ..... B41J 25/308 347/8

(Continued)

FOREIGN PATENT DOCUMENTS

CN 101234564 A 8/2008
JP H07-9862 U 2/1995
JP 2007-045558 A 2/2007

OTHER PUBLICATIONS

An Office Action mailed by the China National Intellectual Property Administration dated Aug. 3, 2020, which corresponds to Chinese Patent Application No. 201910421488.8 and is related to U.S. Appl No. 16/418,215 with English language translation.

*Primary Examiner* — Lam S Nguyen
(74) *Attorney, Agent, or Firm* — Studebaker & Brackett PC

(57) ABSTRACT

An inkjet recording apparatus includes a printing and conveying unit, a recording head, a raising and lowering mechanism, and a controller. The printing and conveying unit conveys a sheet with the sheet loaded on a loading surface thereof. The recording head is disposed opposite to the loading surface and ejects ink onto the sheet conveyed by the printing and conveying unit. The raising and lowering mechanism includes a wire in contact with the printing and conveying unit. The raising and lowering mechanism winds the wire to raise and lower the printing and conveying unit relative the recording head in a cross direction interesting with the loading surface. The controller controls a winding operation by which the raising and lowering mechanism winds the wire according to a degree of inclination of the wire relative to the cross direction.

7 Claims, 5 Drawing Sheets

(56) References Cited

U.S. PATENT DOCUMENTS

| | | | | |
|---|---|---|---|---|
| 2014/0028746 | A1* | 1/2014 | Chen | B41J 11/20 347/8 |
| 2014/0210882 | A1* | 7/2014 | MacKenzie | B41J 25/308 347/8 |
| 2018/0154638 | A1* | 6/2018 | Murashima | B41J 2/16585 |

* cited by examiner

INKJET RECORDING APPARATUS

INCORPORATION BY REFERENCE

The present application claims priority under 35 U.S.C. § 119 to Japanese Patent Application No. 2018-97811, filed on May 22, 2018. The contents of this application are incorporated herein by reference in their entirety.

BACKGROUND

The present disclosure relates to an inkjet recording apparatus.

Known wire feeding devices feed a wire to an external wire-using device. A wire feeding device among the above wire feeding devices drives to rotate a bobbin rotating device in forward and reverse directions. The wire feeding device supplies a wire from a bobbin via a movable pulley for slack adjustment that moves upward and downward. The wire feeding device detects a position of the movable pulley, which moves upward and downward, in a stepwise manner using three photosensors, and controls a rotational direction and a rotational speed of a motor based on a result of detection.

SUMMARY

An inkjet recording apparatus according to an aspect of the present disclosure includes a printing and conveying unit, a recording head, a raising and lowering mechanism, and a controller. The printing and conveying unit conveys a sheet with the sheet loaded on a loading surface of the printing and conveying unit. The recording head is disposed opposite to the loading surface and ejects ink onto the sheet conveyed by the printing and conveying unit. The raising and lowering mechanism includes a wire in contact with the printing and conveying unit. The raising and lowering mechanism winds the wire to raise and lower the printing conveying unit relative to the recording head in a cross direction intersecting with the loading surface. The controller controls a winding operation by which the raising and lowering mechanism winds the wire according to a degree of inclination of the wire relative to the cross direction.

DETAILED DESCRIPTION

Figure 1:
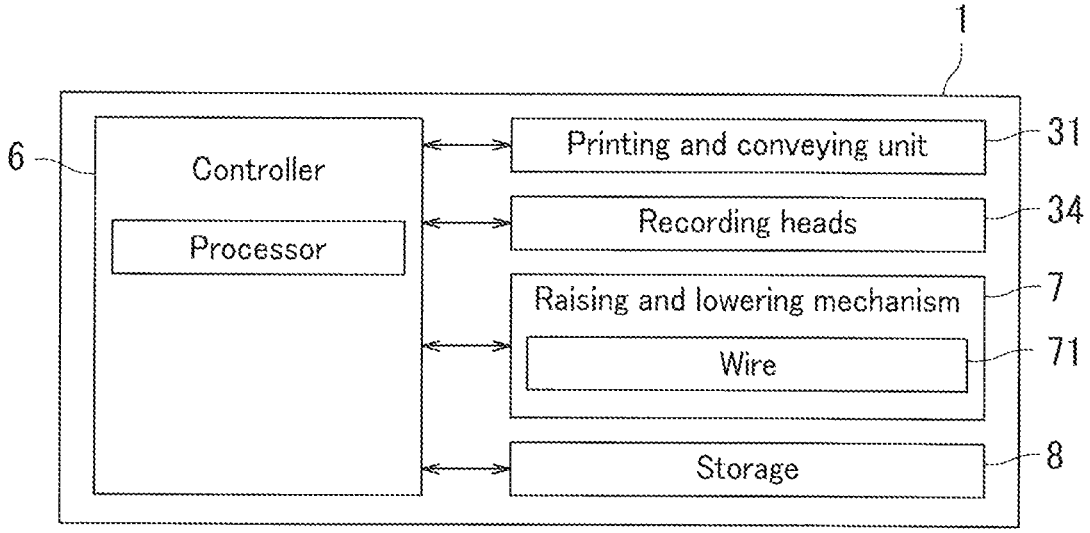
FIG. 1 is a configuration diagram illustrating an inkjet recording apparatus according to an embodiment of the present disclosure.

An embodiment of the present disclosure will be described below with reference to the accompanying drawings. It should be noted that elements in the drawings that are the same or equivalent are labelled using the same reference signs and description thereof is not repeated. In the present embodiment, an X axis and a Y axis extend in parallel to a horizontal axis and a Z axis extends in parallel to a vertical axis. The X axis, the Y axis, and the Z axis are orthogonal to one another. A direction along the Z axis is an example of a "cross direction intersecting with a loading surface" in the present disclosure.

The following describes a general configuration of an inkjet recording apparatus 1 according to an embodiment of the present disclosure with reference to FIG. 1. FIG. 1 is a configuration diagram illustrating the inkjet recording apparatus 1. The inkjet recording apparatus 1 is for example a printer, a copier, a facsimile machine, or a multifunction peripheral having two or more functions of a printer, a copier, and a facsimile machine.

The inkjet recording apparatus 1 includes a printing and conveying unit 31, recording heads 34, a raising and lowering mechanism 7, storage 8, and a controller 6.

The printing and conveying unit 31, the recording heads 34, and the raising and lowering mechanism 7 constitute a part of an image forming section. The printing and conveying unit 31 conveys a sheet with the sheet loaded on a loading surface thereof. The recording heads 34 are disposed opposite to the loading surface. The recording heads 34 eject inks onto the sheet conveyed by the printing and conveying unit 31. The raising and lowering mechanism 7 includes a wire 71. The wire 71 is in contact (for example, line contact) with the printing and conveying unit 31. The raising and lowering mechanism 7 winds the wire 71 to raise and lower the printing and conveying unit 31 relative to the recording heads 34 in the cross direction intersecting with the loading surface. Note that a configuration and operation of the image forming section will be described later in detail with reference to FIG. 2.

The storage 8 includes for example a hard drive disc (HDD), random-access memory (RAM), and read-only memory (ROM). The storage 8 stores therein various data, a control program, and an application program. The control program is a program for controlling operation of each element of the inkjet recording apparatus 1, and is executed by the controller 6.

The controller 6 is a hardware circuit including a processor such as a central processing unit (CPU). The controller 6 controls the operation of each element of the inkjet recording apparatus 1 through the processor reading out and executing the control program stored in the storage 8. For example, the controller 6 controls a winding operation of the raising and lowering mechanism 7 to wind the wire 71 according to a degree of inclination of the wire 71. The processor also reads out and executes the application program stored in the storage 8.

As described with reference to FIG. 1, the printing and conveying unit 31 conveys a sheet with the sheet loaded on the loading surface thereof in the present embodiment. The recording heads 34 are disposed opposite to the loading surface. The recording heads 34 eject inks onto the sheet conveyed by the printing and conveying unit 31. The raising and lowering mechanism 7 includes the wire 71. The wire 71 is in contact with the printing and conveying unit 31. The raising and lowering mechanism 7 winds the wire 71 to raise and lower the printing and conveying unit 31 relative the recording heads 34 in the cross direction intersecting with the loading surface. The controller 6 controls the winding operation of the raising and lowering mechanism 7 to wind the wire 71 according to a degree of inclination of the wire 71. In the above configuration, the controller 6 can control a raising and lowering operation by the raising and lowering mechanism 7 independent of a current position of the printing and conveying unit 31. Thus, mis-winding of the wire 71 when the printing and conveying unit 31 is raised or lowered can be prevented with the above simple configuration.

Figure 2:
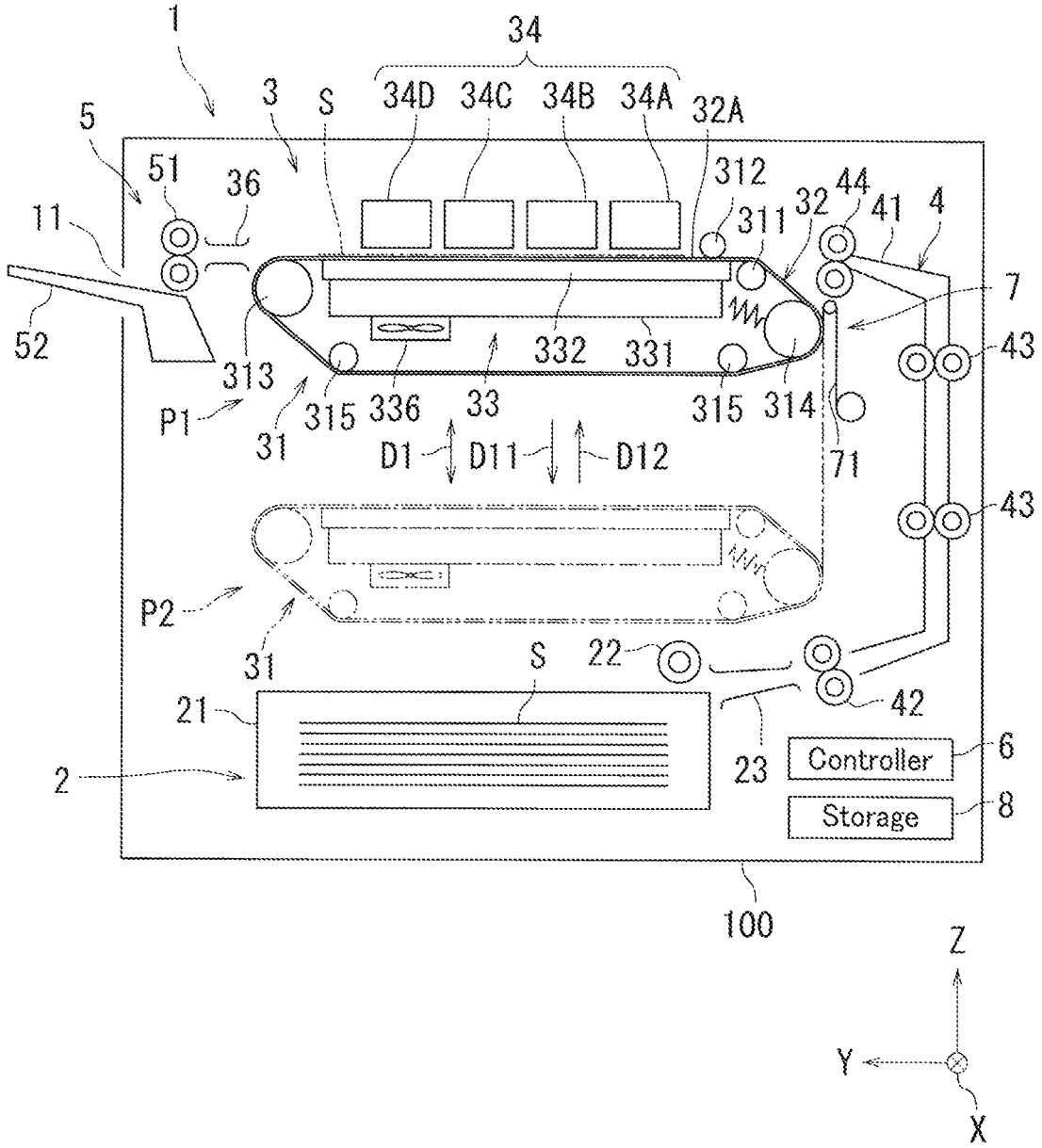
FIG. 2 is a diagram illustrating the inkjet recording apparatus according to the embodiment of the present disclosure.

The following describes details of a configuration and operation of the inkjet recording apparatus 1 with reference to FIG. 2. FIG. 2 is a diagram illustrating the inkjet recording apparatus 1. As illustrated in FIG. 2, the inkjet recording apparatus 1 includes an apparatus housing 100, a feeding section 2, a sheet conveyor section 4, a conveyance guide 36, and a sheet ejecting section 5 in addition to the printing and conveying unit 31, the recording heads 34, the raising and lowering mechanism 7, the storage 8, and the controller 6, which are described with reference to FIG. 1.

The apparatus housing 100 has a substantially rectangular parallelepiped shape, and includes a bottom wall, four side walls rising from the bottom wall, and a top wall. The apparatus housing 100 houses the printing and conveying unit 31, the recording heads 34, the raising and lowering mechanism 7, the storage 8, the controller 6, the feeding section 2, the sheet conveyor section 4, the conveyance guide 36, and a part of the sheet ejecting section 5.

The feeding section 2 includes a cassette 21, a feeding roller 22, and a guide plate 23. The feeding section 2 is located in a lower part of the apparatus housing 100. The terms "low" or "lower" refers to for example low or lower in a direction along a vertical axis. The cassette 21 accommodates a plurality of sheets S therein. The sheets S are for example made from paper or a synthetic resin. The feeding roller 22 picks out a sheet S from the cassette 21. The picked sheet S is guided by the guide plate 23 to a first conveyance roller pair 42.

The sheet conveyor section 4 includes a sheet conveyance path 41, the first conveyance roller pair 42, a second conveyance roller pair 43, and a registration roller pair 44. The sheet S is fed into the sheet conveyance path 41 by the first conveyance roller pair 42, and conveyed in a conveyance direction of the sheet S by the second conveyance roller pair 43. The sheet S then comes in contact with the registration roller pair 44 to be stopped for skew correction. The sheet S is then fed to an image forming section 3 by the registration roller pair 44 in synchronization with timing of image formation.

The image forming section 3 further includes the conveyance guide 36 in addition to the printing and conveying unit 31, the recording heads 34, and the raising and lowering mechanism 7, which are described with reference to FIG. 1. The image forming section 3 is disposed above the feeding section 2. The term "above" refers to for example above in the direction along the vertical axis.

The recording heads 34 eject inks on the sheet S conveyed by the printing and conveying unit 31. Specifically, four recording heads 34A, 34B, 34C, and 34D are disposed side by side in stated order from upstream to downstream in terms of the conveyance direction of the sheet S. The recording heads 34A, 34B, 34C, and 34D each include a plurality of nozzles (not illustrated) arranged in a width direction of a conveyor belt 32. The inks (a yellow ink, a magenta ink, a cyan ink, and a black ink) are ejected from the nozzles to form an image representing for example a character or a pattern on the sheet S. The recording heads 34A, 34B, 34C, and 34D are of line type, and constitute a line head inkjet recording apparatus. The recording heads 34A, 34B, 34C, and 34D, which have substantially the same configuration, may be referred collectively to as the recording heads 34.

The printing and conveying unit 31 includes a belt speed detection roller 311, a placement roller 312, a drive roller 313, a tension roller 314, a guide roller pair 315, the conveyor belt 32, and a negative pressure application section 33. The printing and conveying unit 31 conveys the sheet S in a specific direction (leftward in FIG. 2). The printing and conveying unit 31 has a substantially flat oblong rectangular parallelepiped shape when viewed from a side.

The printing and conveying unit 31 conveys the sheet S with the sheet S loaded on a loading surface 32A thereof. Specifically, the loading surface 32A is a surface of an outer circumferential surface of the conveyor belt 32 on which the sheet S is to be loaded. The conveyor belt 32 is an endless belt, and is wound around the belt speed detection roller 311, the drive roller 313, the tension roller 314, and the guide roller pair 315. The conveyor belt 32 conveys the sheet S with the sheet S loaded on the loading surface 32A thereof by being driven in the conveyance direction of the sheet S (counterclockwise in FIG. 2). The printing and conveying unit 31 is disposed opposite to the four recording heads 34 (34A, 34B, 34C, and 34D) in the apparatus housing 100. That is, the recording beads 34 are disposed opposite to the loading surface 32A. Unless otherwise specifically limited, the term "ascend" refers to a direction toward the recording heads 34 from the loading surface 32A in a cross direction D1 intersecting with the loading surface 32A. Also, the term "descend" refers to a direction away from the recording heads 34 from the loading surface 32A in the cross direction D1. The cross direction D1 intersecting with the loading surface 32A is for example a direction perpendicular to the loading surface 32A.

The tension roller 314 applies tension to the conveyor belt 32 so as to prevent the conveyor belt 32 from sagging.

The belt speed detection roller 311 is disposed upstream of the negative pressure application section 33 in terms of the conveyance direction of the sheet S (right side in FIG. 2), and rotates by friction force generated with the conveyor belt 32. The belt speed detection roller 311 includes a pulse plate (not illustrated). The pulse plate rotates together with the belt speed detection roller 311. Measurement of a rotational speed of the pulse plate results in detection of a circulation speed of the conveyor belt 32.

The drive roller 313 is disposed downstream of the negative pressure application section 33 in terms of the conveyance direction of the sheet S (left side in FIG. 2). Preferably, the drive roller 313 is disposed in a manner to keep a part of the conveyor belt 32 located opposite to the recording heads 34 flat in cooperation with the belt speed detection roller 311. The drive roller 313 is driven to rotate by a motor (not illustrated) to circulate the conveyor belt 32 in a counterclockwise direction in FIG. 2.

The guide roller pair 315 is disposed below the negative pressure application section 33 to define a space below the negative pressure application section 33.

The placement roller 312 is a driven roller. The placement roller 312 is disposed opposite to a guide member 332 with the conveyor belt 32 therebetween. The placement roller 312 guides the sheet S fed from the registration roller pair 44 onto the conveyor belt 32 and places the sheet S on the conveyor belt 32.

The negative pressure application section 33 applies negative pressure to the sheet S through the conveyor belt 32 to suck the sheet S to the conveyor belt 32. The negative pressure application section 33 is disposed on a reverse side (a lower side in FIG. 2) of the conveyor belt 32 so as to be opposite to the four recording heads 34 with the conveyor belt 32 therebetween. The negative pressure application section 33 includes an airflow chamber 331, the guide member 332, and a negative pressure generation section 336.

The airflow chamber 331 defines a space in which negative pressure for sucking the sheet S toward the conveyor belt 32 is generated. The airflow chamber 331 is formed with a bottomed box member with an open top. A top surface of a side wall constituting the airflow chamber 331 is fixed to the guide member 332. The open top of the airflow chamber 331 is covered with the guide member 332.

The guide member 332 supports the sheet S with the conveyor belt 32 therebetween. The guide member 332 is for example a conveyor plate made from a metal material. The guide member 332 has through holes (not illustrated). The through holes penetrate the guide member 332 from bottom surfaces of grooves (not illustrated) formed in an upper surface portion of the guide member 332.

The negative pressure generation section 336 is a device that generates negative pressure in the airflow chamber 331, and is for example a fan or a vacuum pump. The negative pressure generation section 336 is disposed on the lower surface of the airflow chamber 331. The negative pressure generation section 336 generates negative pressure in the airflow chamber 331 by exhausting air in the airflow chamber 331 out of the airflow chamber 331 through an exhaust port (not illustrated). The negative pressure generated in the airflow chamber 331 sucks air through suction holes (not illustrated) in the conveyor belt 32 and the through holes in the guide member 332 to attach the sheet S to the conveyor belt 32. In the above configuration, the printing and conveying unit 31 is able to suck the sheet S onto the conveyor belt 32 for conveyance. The sheet S is conveyed from the conveyor belt 32 to the conveyance guide 36.

The sheet ejecting section 5 includes an ejection roller pair 51 and an exit tray 52. The sheet S having passed through the conveyance guide 36 is fed toward an exit port 11 and guided to the exit tray 52 by the ejection roller pair 51, thereby being ejected out of the apparatus housing 100 through the exit port 11.

The raising and lowering mechanism 7 winds the wire 71 to raise and lower the printing and conveying unit 31 relative the recording heads 34 in the cross direction D1 intersecting with the loading surface 32A. Specifically, the controller 6 controls the raising and lowering mechanism 7 so that the printing and conveying unit 31 moves in a descending direction D11 or an ascending direction D12 between an upper limit position P1 and a lower limit position P2. The printing and conveying unit 31 reaching the upper limit position P1 or the lower limit position P2 can be detected by for example a sensor (not illustrated). The lower limit position P2 may be for example a position where a lower surface of the printing and conveying unit 31 comes in contact with a frame stay (not illustrated) of the apparatus housing 100 or a position where the lower surface of the printing and conveying unit 31 is spaced a specific distance apart from an upper end of the feeding section 2.

The raising and lowering mechanism 7 lowers the printing and conveying unit 31 before a capping unit (not illustrated) or a wiper unit (not illustrated) of the image forming section 3 for example is moved to a position opposite to the recording heads 34, in order to ensure a space in which the capping unit or the wiper unit moves. The raising and lowering mechanism 7 also lowers the printing and conveying unit 31 before a start of a maintenance operation for example for jab clearance in order to ensure a space into which a hand of a user is inserted. The raising and lowering mechanism 7 raises the printing and conveying unit 31 to return the printing and conveying unit 31 to a location opposite to the recording heads 34.

Figure 3A:
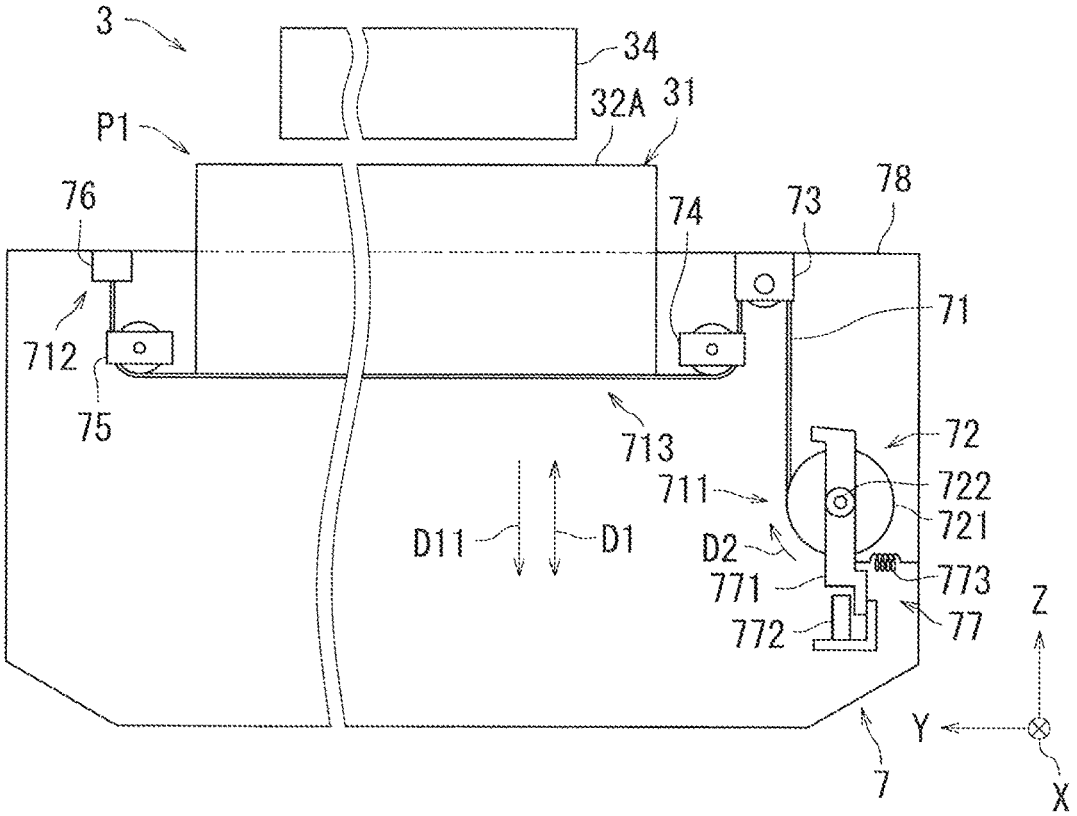
FIGS. 3A and 3B are diagrams illustrating a part of an image forming section of the inkjet recording apparatus.
Figure 3B:
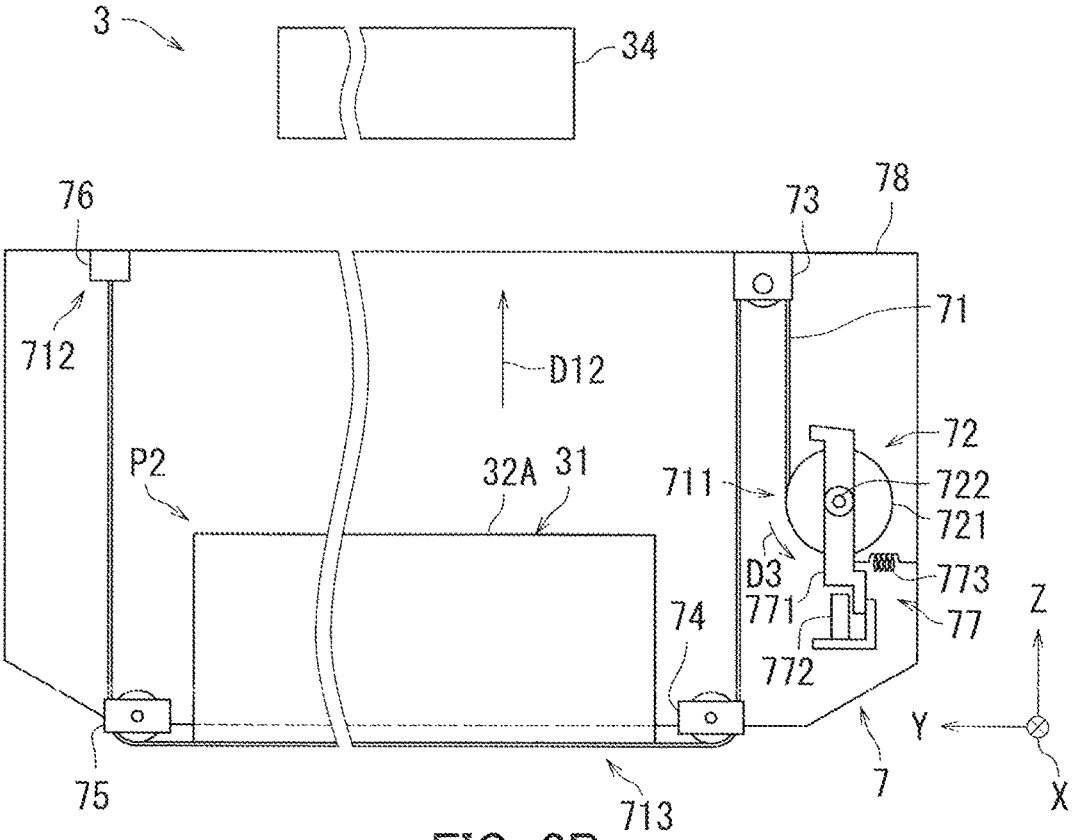

The following describes a configuration and operation of the raising and lowering mechanism 7 in detail with reference to FIG. 2 and with further reference to FIGS. 3A, 3B, 4A, and 4B. FIGS. 3A and 3B are diagrams each illustrating a part of the image forming section 3. In order to avoid excessive complexity in the drawings, the printing and conveying unit 31 and the recording heads 34 are illustrated in a simplified manner in FIGS. 3A, 3B, and FIG. 4A.

FIG. 3A illustrates a state in which the printing and conveying unit 31 is positioned at the upper limit position P1 (also referred to below as an "upper limit placement state"). In the upper limit placement state, the recording heads 34 form an image on the sheet S loaded on the loading surface 32A. Lower ends of the recording heads 34 are close to the loading surface 32A with a distance (for example, 3 mm) apart from the loading surface 32A in the upper limit placement state. The sheet S is conveyable within the distance.

The raising and lowering mechanism 7 further includes a winding section 72, a first pulley 73, a second pulley 74, a third pulley 75, a fixing section 76, a detection section 77, and a frame member 78 in addition to the wire 71 described with reference to FIGS. 1 and 2.

The wire 71 is a linear member and is made from for example either or both a metal and a synthetic resin. The wire 71 has a cross-section diameter of for example 1 mm. Through use of the wire 71 as described above, the winding section 72 can be compact.

The wire 71 has two ends 711 and 712, of which one end 711 is fixed to the winding section 72. The one end 711 corresponds to an "end of the wire 71 opposite to an end thereof on a side where the wire 71 is in contact with the printing and conveying unit 31". The other end 712 is fixed to the fixing section 76. The other end 712 corresponds to the "end of the wire 71 on a side where the wire 71 is in contact with the printing and conveying unit 31". Specifically, the wire 71 extends from the winding section 72 to the fixing section 76 via the first pulley 73, the second pulley 74, and the third pulley 75 in stated order. In the above configuration, a portion of the wire 71 extending in a direction in which the loading surface 32A of the printing and conveying unit 31 extends between the second pulley 74 and the third pulley 75 is defined as an extent 713. The direction in which the loading surface 32A extends is for example a horizontal direction. In the following description, the extent 713 of the wire 71 extending in the direction in which the loading surface 32A extends between the second pulley 74 and the third pulley 75 may be referred to as a "horizontal extent". The horizontal extent 713 is in contact with the lower surface of the printing and conveying unit 31 in a slidable manner. The lower surface of the printing and conveying unit 31 is for example constituted by a frame of the printing and conveying unit 31. A catch member that caches the wire 71 in a slidable manner in the direction along the loading surface 32A may be provided on the lower surface of the printing and conveying unit 31. In the above configuration, the printing and conveying unit 31 is supported substantially horizontally. As a result, the printing and conveying unit 31 having any size can be supported by changing a distance between the second pulley 74 and the third pulley 75. Thus, the posture of the printing and conveying unit 31 can be easily made stable independent of the size of the printing and conveying unit 31 from left to right.

The winding section 72 winds the wire 71 by rotating about a rotary shaft 722 as an axis. Specifically, the winding section 72 includes a winding pulley 721, the rotary shaft 722, and a drive mechanism (not illustrated). Of the two ends 711 and 712 of the wire 71, the end 711 opposite to the end 712 on the side where the wire 71 is in contact with the printing and conveying unit 31 is fixed to the winding section 72. The winding pulley 721 is fixed to the rotary shaft 722. The winding pulley 721 winds the wire 71 by rotation of the rotary shaft 722 to reel in and out the wire 71. The rotary shaft 722 is a shaft member. The rotary shaft 722 has an end that is connected to the drive mechanism, and is supported by the frame member 78 in a rotatable manner. The rotary shaft 722 extends along the X axis and in parallel for example to a rotational axis direction of each roller (for example, the drive roller 313) of the printing and conveying unit 31. The drive mechanism includes for example a drive motor and a gear. The drive mechanism drives to rotate the rotary shaft 722 according to a control signal transmitted from the controller 6.

The first pulley 73 is disposed between the printing and conveying unit 31 and the winding section 72. The first pulley 73 is for example a fixed pulley. The first pulley 73 is fixed to the frame member 78. The first pulley 73 supports the wire 71 in a slidable manner at a location above the winding section 72.

The wire 71 in a reel-in state extends between the winding section 72 and the first pulley 73, and preferably extends in the cross direction D1. The reel-in state is a state in which a portion of the wire 71 that is wound in a specific winding direction remains in the winding pulley 721. That is, the reel-in state is a state in which the winding section 72 does not fully reel out the wire 71 wound in the specific winding direction. The specific winding direction is for example a clockwise winding direction in FIG. 3A. In detail, the specific winding direction is a direction in which the other end 712 of the wire 71 advances clockwise in a peripheral direction of the winding pulley 721 along an outer peripheral surface of the winding pulley 721 from a fixed point where the end 711 of the wire 71 is fixed to the winding pulley 721 in a state in which the winding pulley 721 is not rotated.

The second pulley 74 is disposed between the printing and conveying unit 31 and the first pulley 73. The second pulley 74 is for example a fly pulley. The second pulley 74 is located below the first pulley 73, and is slidable with respect to the wire 71. The second pulley 74 may be disposed at the lower surface of the printing and conveying unit 31. The wire 71 extends between the first pulley 73 and the second pulley 74, and preferably extends therebetween in the cross direction D1.

The third pulley 75 is disposed between the second pulley 74 and the fixing section 76. That is, the third pulley 75 is disposed on an opposite side of the printing and conveying unit 31 to the second pulley 74 with the horizontal extent 713 therebetween. The third pulley 75 is for example a fly pulley similarly to the second pulley 74. Preferably, the third pulley 75 is located below the fixing section 76 at the same level as the second pulley 74 and is slidable with respect to the wire 71. The Second pulley 74 may be disposed at the lower surface of the printing and conveying unit 31. In the above configuration, the printing and conveying unit 31 is supported substantially horizontally.

The fixing section 76 is disposed on an opposite side of the horizontal extent 713 to the first pulley 73. The fixing section 76 is for example fixed to the frame member 78. The other end 712 of the wire 71 is fixed to the fixing section 76 for example at a location above the third pulley 75.

The detection section 77 includes an actuator 771, a sensor 772, and a spring member 773. The detection section 77 is for example a photointerrupter. The actuator 771 is for example supported by the rotary shaft 722 of the winding section 72 in a swingable manner. The sensor 772 detects turning of the actuator 771. The sensor 772 is for example a thru-beam sensor. The spring member 773 connects the actuator 771 to the frame member 78 to urge a lower end of the actuator 771 in a direction away from the sensor 772. The spring member 773 is for example an extension coil spring. A configuration of the detection section 77 will be described later in detail with reference to FIG. 4B.

The frame member 78 is for example a substantially rectangular plate shaped frame when viewed from a side. The frame member 78 is fixed to a sidewall of the apparatus housing 100. For example, the frame member 78 is fixed to a wall of the apparatus housing 100 located to the rear in a direction of a rotational axis of the drive roller 313 in FIG. 2.

Note that the inkjet recording apparatus 1 may include a plurality of raising and lowering mechanisms (not illustrated) having the same configuration as that of the raising and lowering mechanism 7. For example, a raising and lowering mechanism may be additionally disposed in front of the raising and lowering mechanism 7 illustrated in FIGS. 3A and 3B for the printing and conveying unit 31 in a substantially flat and oblong rectangular parallelepiped shape. The two raising and lowering mechanisms may share the rotary shaft 722 of the winding section 72 of the raising and lowering mechanism 7 as a common shaft. Through the above arrangement, the respective raising and lowering mechanisms in a pair can support front ends and rear ends of the printing and conveying unit 31 (of four corner ends of the lower surface of the printing and conveying unit 31, for example). Thus, the printing and conveying unit 31 can be easily kept horizontally.

In the upper limit placement state, the controller 6 causes the drive mechanism to drive to rotate the rotary shaft 722 in a rotational direction D2 (clockwise in FIG. 3A), thereby rotating the winding pulley 721 in the rotational direction D2. Through the rotation of the winding pulley 721, the printing and conveying unit 31 descends from the upper limit position P1 toward the lower limit position P2 illustrated in FIG. 3B according to movement of the wire 71. That is, a specific rotational direction corresponding to a direction in which the printing and conveying unit 31 descends (also referred to below as a "lowering rotational direction") is the rotational direction D2 in the present embodiment.

FIG. 3B illustrates a state in which the printing and conveying unit 31 is positioned at the lower limit position P2 (also referred to below as a "lower limit placement state"). In the lower limit placement state, a distance between the loading surface 32A and the lower ends of the recording heads 34 is for example 200 mm. In this state, the horizontal extent 713 of the wire 71 is lowered for example to the vicinity of a lower end of the frame member 78. The printing and conveying unit 31 is located at the lower limit position P2 in a reel-out state. The reel-out state is a state in which a portion of the wire 71 that is wound does not remain in the winding pulley 721. That is, the reel-out state is a state in which the winding section 72 fully reels out the wire 71 wound in the specific winding direction.

In the lower limit placement state, the controller 6 causes the drive mechanism to drive to rotate the rotary shaft 722 in a rotational direction D3 (counterclockwise in FIG. 3B), thereby rotating the winding pulley 721 in the rotational direction D3. Through the rotation of the winding pulley 721, the printing and conveying unit 31 ascends from the lower limit position P2 toward the upper limit position P1 described with reference to FIG. 3A according to movement of the wire 71. That is, a specific rotational direction corresponding to a direction in which the printing and conveying unit 31 ascends (also referred to below as a "raising rotational direction") is the rotational direction D3 in the present embodiment.

Figure 4A:
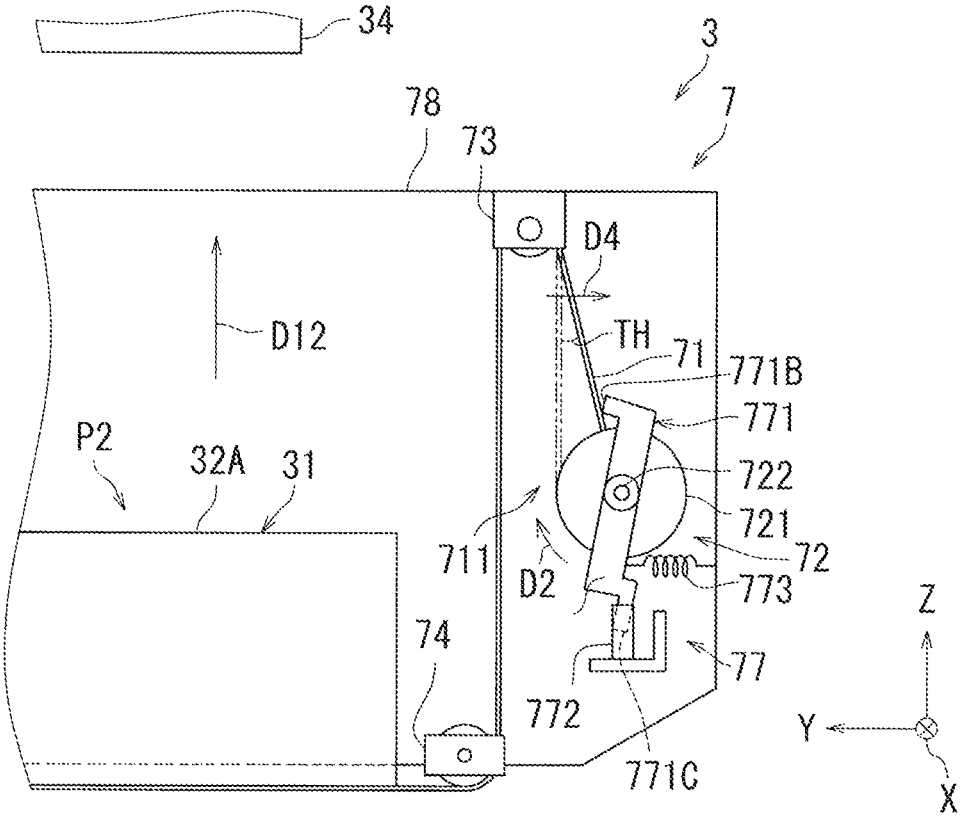
FIG. 4A is an enlarged view of a part of the image forming section.
Figure 4B:
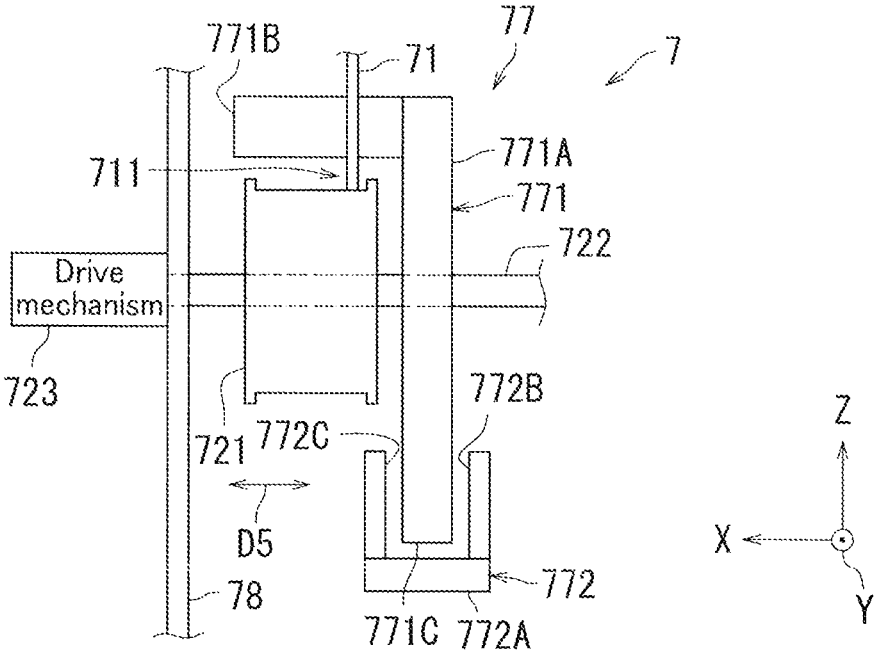
FIG. 4B is an enlarged view of a part of a raising and lowering mechanism of the inkjet recording apparatus.

FIG. 4A is a diagram illustrating a part of the image forming section 3 in an enlarged scale. FIG. 4B is a diagram illustrating a part of the raising and lowering mechanism 7 in an enlarged scale. FIGS. 4A and 4B each illustrate a state in which the winding pulley 721 starts rotating in a direction reverse to the raising rotational direction D3 from the lower limit placement state described with reference to FIG. 3B.

As illustrated in FIG. 4A, the detection section 77 detects that a degree of inclination of the wire 71 extending between the winding section 72 and the first pulley 73 exceeds a threshold TH. The threshold TH is a threshold angle. In detail, when the winding pulley 721 rotates in the direction reverse to the raising rotational direction D3 (rotates in the rotational direction D2), the wire 71 in the reel-out state inclines relative to the cross direction D1 intersecting with the loading surface 32A. That is, a portion of the wire 71 extending between the winding section 72 and the first pulley 73 moves about the first pulley 73 as a pivot in a direction D4 away from a portion of the wire 71 extending between the first pulley 73 and the second pulley 74 (rightward direction in the Y axis direction in FIG. 4A) by the reverse rotation of the winding pulley 721. The threshold TH is for example 20 degrees, but may be changed according to locations of the first pulley 73 and the winding pulley 721 or changed by user adjustment of detection sensitivity of the detection section 77.

When the wire 71 comes in contact with the actuator 771 to turn the actuator 771 in the rotational direction D2, the sensor 772 detects that the degree of inclination exceeds the threshold TH. Specifically, as illustrated in FIG. 4B, the actuator 771 includes a base 771A and a contact portion 771B. The actuator 771 is substantially in an inverted L shape. The base 771A extends in a radial direction of the winding section 72. The base 771A has a through hole through which the rotary shaft 722 is inserted. The base 771A does not follow the rotation of the rotary shatf 722 when a drive mechanism 723 of the winding section 72 drives to rotate the rotary shaft 722. The contact portion 771B extends in a direction D5 along the rotary shaft 722 from one end of the base 771A. The sensor 772 includes a bottom portion 772A, a light emitter 772B, and a light receiver 772C. The light emitter 772B stands up from the bottom portion 772A. In the sensor 772, the light emitter 772B emits infrared rays and the light receiver 772C receives the infrared rays.

When the end 711 of the wire 71 moves along the peripheral surface of the winding pulley 721 through rotation of the winding pulley 721 in the rotational direction D2, the wire 71 comes in contact with the contact portion 771B. Through the contact, the actuator 771 turns in the rotational direction D2. A lower end 771C of the actuator 771 moves between the light emitter 772B and the light receiver 772C. The infrared rays emitted from the light emitter 772B are blocked by the lower end 771C. As a result, the sensor 772 detects that the degree of inclination exceeds the threshold TH.

The controller 6 causes the winding section 72 to stop rotating based on a result of detection by the detection section 77. Specifically, the detection section 77 transmits a signal indicating the result of detection to the controller 6. The drive mechanism 723 stops drive and rotation of the rotary shaft 722 in the rotational direction D2 in response to a control signal transmitted from the controller 6.

As described with reference to FIGS. 2 to 4B, the winding section 72 winds the wire 71 by rotating about the rotary shaft 722 as an axis in the present embodiment. The first pulley 73 supports the wire 71 at a location above the winding section 72 in a slidable manner. The detection section 77 detects that the degree of inclination of the wire 71 extending between the winding section 72 and the first pulley 73 exceeds the threshold TH. The controller 6 stops rotation of the winding section 72 based on a result of detection. In the above configuration, even in a state for example in which the winding section 72 fully reels out the wire 71 when raising the printing and conveying unit 31 toward the recording heads 34, rotation of the winding section 72 can be controlled so that the winding section 72 rotates in an appropriate rotational direction. In other words, the winding section 72 can be easily prevented from rotating in a state different from an appropriate rotation state. Thus, the raising and lowering of the printing and conveying unit 31 by winding the wire 71 can be controlled with a simple configuration.

Furthermore, the wire 71 preferably extends in the cross direction D1 intersecting with the loading surface 32A between the first pulley 73 and the second pulley 74 in the present embodiment. This can suppress excessive load application to the wire 71 when the raising and lowering mechanism 7 raises or lowers the printing and conveying unit 31.

Furthermore, in the present embodiment, when the wire 71 comes in contact with the actuator 771 to turn the actuator 771, the sensor 772 detects that the degree of inclination exceeds the threshold TH. Thus, inclination of the wire 71 can be detected through utilization of change in rotational direction of the winding section 72 without need for specific motive power.

Moreover, the actuator 771 preferably includes the base 771A and the contact portion 771B in the present embodiment. This can enable detection of inclination of the wire 71 with a further simple configuration.

According to the present embodiment, the printing and conveying unit 31 is located at the lower limit position P2 in a state in which the wire 71 is in the reel-out state. When the winding section 72 rotates in a direction reverse to the raising rotational direction D3, the wire 71 inclines with respect to the cross direction D1 intersecting with the loading surface 32A. The detection section 77 accordingly detects the inclination of the wire 71. In the above configuration, when the printing and conveying unit 31 is in the lower limit placement state, the winding section 72 can be prevented from rotating in the lowering rotational direction D2 even if it is not recognized, due to some malfunction, that the printing and conveying unit 31 has reached the lower limit position P2. Thus, unintentional ascending of the printing and conveying unit 31 by unnecessary reverse rotation of the winding section 72 can be prevented with a simple configuration.

Figure 5:
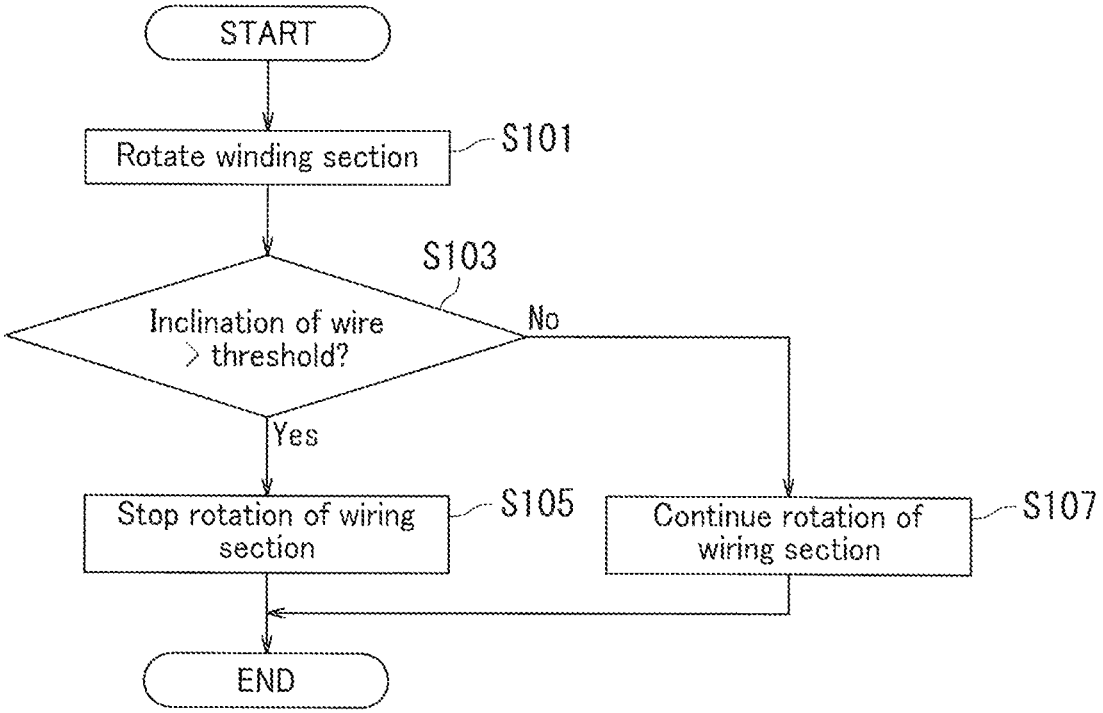
FIG. 5 is a flowchart depicting a winding process.

The following describes operation of the winding section 72 with reference to FIGS. 1 to 5. FIG. 5 is a flowchart depicting a winding process. Through execution of Steps S101 to S107, the inkjet recording apparatus 1 performs the winding process by which the winding section 72 is rotated. The following provides a more specific explanation.

In Step S101, the controller 6 causes the winding section 72 to rotate. The process proceeds to Step S103.

Subsequently, the controller 6 determines whether or not the degree of inclination of the wire 71 is larger than the threshold TH in Step S103. When it is determined that the degree of inclination of the wire 71 is larger than the threshold TH (Yes in step S103), the process proceeds to Step S105. When it is determined that the degree of inclination of the wire 71 is not larger than the threshold TH by contrast (No in step S103), the process proceeds to Step S107.

When an affirmative determination is made in Step S103, the controller 6 stops rotation of the winding section 72 in Step S105. The process then ends.

When a negative determination is made in Step S103, the controller 6 continues rotation of the winding section 72 in Step S107. The process then ends.

Through the above, an embodiment of the present disclosure has been described so far with reference to the drawings (FIGS. 1 to 5). However, the present disclosure is not limited to the above embodiment and can be practiced in various manners within a scope not departing from the gist of the present disclosure. Various forms of disclosure are possible through appropriate combinations of elements of configuration in embodiments including the following (1) to (3). For example, some of the elements of configuration in the embodiments may be omitted. Alternatively or additionally, elements of configuration in different embodiments may be combined as appropriate. The drawings schematically illustrate main elements of configuration in order to facilitate understanding. Properties such as thickness, length, the number, and intervals of the elements of configuration illustrated in the drawings may differ from actual properties in order to facilitate preparation of the drawings. Furthermore, properties of the elements of configuration described in the above embodiment, such as materials, shapes, and dimensions, are merely examples and are not intended as specific limitations. Various alterations may be made so long as there is no substantial deviation from the configuration of the present disclosure.

(1) The raising and lowering mechanism 7 described with reference to FIGS. 1 to 5 includes the wire 71, which should not be taken to limit the present disclosure. The raising and lowering mechanism 7 only needs to include a linear member or a band-shaped member, which is an alternative to the wire 71.

(2) The sensor 772 described with reference to FIGS. 3A, 3B, 4A, and 4B is a thru-beam sensor, which should not be taken to limit the present disclosure. The sensor 772 may be for example a reflective sensor. The reflective sensor as the sensor 772 detects the inclination of the wire 71 through emission of infrared rays from a light emitter and receipt by a light receiver of infrared rays reflected by the actuator 771. The sensor 772 may be a sensor that detects visible light or ultrasonic waves.

(3) The raising and lowering mechanism 7 described with reference to FIGS. 3A, 3B, 4A, and 4B includes the second pulley 74, the third pulley 75, and the fixing section 76, which should not be taken to limit the present disclosure. The raising and lowering mechanism 7 only needs to be capable of raising and lowering the printing and conveying unit 31 by reeling in and out the wire 71 in contact with the printing and conveying unit 31. For example, the other end 712 of the wire 71 may be connected to the frame of the printing and conveying unit 31 to suspend the printing and conveying unit 31. In such an embodiment, the second pulley 74 and the third pulley 75 can be omitted, for example. Alternatively, a pulley may be added to the raising and lowering mechanism 7 in addition to the second pulley 74 and the third pulley 75.

What is claimed is:

1. An inkjet recording apparatus comprising:

a printing and conveying unit configured to convey a sheet with the sheet loaded on a loading surface of the printing and conveying unit;

a recording head disposed opposite to the loading surface and configured to eject ink onto the sheet conveyed by the printing und conveying unit;

a raising and lowering mechanism including a wire in contact with the printing and conveying unit; and a controller, wherein the raising and lowering mechanism winds the wire to raise and lower the printing and conveying unit relative to the recording head in a cross direction, the cross direction being a direction intersecting with the loading surface, and the controller controls a winding operation by which the raising and lowering mechanism winds the wire according to a degree of inclination of the wire relative to the cross direction.

2. The inkjet recording apparatus according to claim 1, wherein the raising and lowering mechanism includes a winding section, a first pulley and a detection section, the winding section includes a rotary shaft and rotates about the rotary shaft as an axis to wind the wire, the wire has two ends that are opposite to each other, one end being located on a side where the wire is in contact with the printing and conveying unit, the other end being on the side where the wire is in contact with the winding section, the first pulley is disposed above the winding section between the printing and conveying unit and the winding section to support the wire in a slidable manner, the detection section detects that a degree of inclination of a portion of the wire extending between the winding section and the first pulley exceeds a threshold, and the controller causes the winding section to stop rotating based on a result of detection by the detection section.

3. The inkjet recording apparatus according to claim 2, wherein the raising and lowering mechanism further includes a second pulley, the second pulley is disposed below the first pulley between the printing and conveying unit and the first pulley in slidable manner with respect to the wire, and the wire extends in the cross direction between the first pulley and the second pulley.

4. The inkjet recording apparatus according to claim 3, wherein the raising and lowering mechanism further includes a third pulley, a fixing section, and a frame member, the third pulley is disposed between the second pulley and the fixing section, the other end of the two ends of the wire on the side where the wire is in contact with the printing and conveying unit is fixed to the fixing section, the rotary shaft of the winding section is supported by the frame member, the first pulley and the fixing section are each fixed to the frame member, in the wire, an extent extending in a direction along the loading surface of the printing and conveying unit is defined between the second pulley and the third pulley, and the extent of the wire is in contact with a lower surface of the printing and conveying unit in a slidable manner.

5. The inkjet recording apparatus according to claim 2, wherein the detection section of the raising and lowering mechanism includes an actuator and a sensor, the actuator being supported by the rotary shaft of the winding section in a swingable manner, the sensor being configured to detect turning of the actuator, and when the wire comes in contact with the actuator to turn the actuator, the sensor detects that the degree of inclination of the wire exceeds the threshold.

6. The inkjet recording apparatus according to claim 5, wherein the actuator includes a base and a contact portion, the base extending in a radial direction of the winding section, the contact portion extending in a direction along the rotary shaft of the winding section from one end of the base, and the actuator turns by the wire coming in contact with the contact portion.

7. The inkjet recording apparatus according to claim 2, wherein the wire in a reel-in state extends in the cross direction between the winding section and the first pulley, the reel-in state is a state in which a portion of the wire that is wound remains in the winding section, when the winding section rotates in a direction reverse to a rotational direction corresponding to a direction in which the printing and conveying unit ascends in a reel-out state of the wire, the wire inclines relative to the cross direction, the reel-out state being a state in which a portion of the wire that is wound does not remain in the winding section, and the printing and conveying unit is located at a lower limit position in the reel-out state.

* * * * *